US007210615B2

(12) United States Patent
McKenna

(10) Patent No.: US 7,210,615 B2
(45) Date of Patent: May 1, 2007

(54) CORNER WRAP TRAY

(75) Inventor: David J. McKenna, Plainfield, IL (US)

(73) Assignee: Weyerhaeuser Company, Federal Way, WA (US)

( * ) Notice: Subject to any disclaimer, the term of this patent is extended or adjusted under 35 U.S.C. 154(b) by 0 days.

(21) Appl. No.: 10/998,695

(22) Filed: Nov. 29, 2004

(65) Prior Publication Data

US 2006/0113366 A1 Jun. 1, 2006

(51) Int. Cl.
*B65D 5/28* (2006.01)
*B65D 5/468* (2006.01)
*B65D 21/032* (2006.01)

(52) U.S. Cl. ..... 229/192; 229/117.16; 229/125.22; 229/918

(58) Field of Classification Search ..... 229/117.16, 229/125.22, 190, 192, 198, 125.19, 915, 229/918, 919
See application file for complete search history.

(56) References Cited

U.S. PATENT DOCUMENTS 227,447 A * 5/1880 Sabin ..... 229/125.22
1,515,983 A * 11/1924 Williams ..... 229/192
1,667,354 A * 4/1928 Lupien ..... 229/192
1,985,779 A * 12/1934 Himes ..... 229/192
2,111,376 A * 3/1938 Van Wingen ..... 229/117.16
2,201,462 A * 5/1940 Wells et al. ..... 229/198
2,239,233 A * 4/1941 Hyndman ..... 229/192
2,269,247 A * 1/1942 Borah ..... 229/122.26
2,522,597 A * 9/1950 Blandford ..... 229/192
2,718,998 A * 9/1955 Bemiss ..... 229/192
3,214,015 A * 10/1965 Budd ..... 206/599
3,438,488 A * 4/1969 Rohde ..... 206/454
3,704,824 A * 12/1972 Croley ..... 229/192
3,721,381 A * 3/1973 Locke ..... 229/117.16
3,741,462 A * 6/1973 Flint et al. ..... 229/117.16
4,103,819 A 8/1978 Muise
4,319,710 A * 3/1982 Osborne ..... 229/190
4,417,686 A * 11/1983 Wozniacki ..... 229/117.16
5,052,615 A * 10/1991 Ott et al. ..... 229/125.19
5,307,928 A * 5/1994 Bishop ..... 206/320

OTHER PUBLICATIONS

McKenna D, "10 Ream 8½x 11 Tray Shipper Cover," design drawing, Weyerhaeuser Co., Jan. 2004.
McKenna D, "10 Ream 8½x 11 Bottom Tray Shipper," design drawing, Weyerhaeuser Co., Jan. 2004.

* cited by examiner

*Primary Examiner*—Gary E. Elkins

(57) ABSTRACT

A container comprising a box having a bottom wall, side walls and end walls extending upwardly from the bottom wall, corner panels extending from either the end walls or the side walls and attached to outer faces of the side walls or the end walls, reinforcing panels extending from the side walls or the end walls and attached to inner faces of the end walls, a cover having an top wall and side walls and end walls extending downwardly from said top wall, the cover being placed over the box with the side walls and end walls of said cover extending outside of the box, and straps around the box and the cover and over the corner panels; and a blank for the box.

4 Claims, 3 Drawing Sheets

CORNER WRAP TRAY

FIELD OF THE INVENTION

This is directed to a shipping container and a blank for the box of the container.

BACKGROUND OF THE INVENTION

Products being shipped should arrive at their destination in substantially the same state as they started their trip. For example, if packaged reams of paper are being shipped, the packages should arrive at their destination without the outer wrappers being ripped or the paper being damaged.

SUMMARY OF THE INVENTION

The present construction provides strong corners which reduces damage to the contained material. An embodiment has outside panels at the ends of the side or end walls which provide greater protection to the corners of the container. This construction also places the side or end walls closer to the product so there is less chance for the product to move in the container. This reduces damage to the product. The outside panels also the visually ensure that straps will be placed over the panels with two layers of protection for the enclosed product instead of over the side or end wall with one layer of protection. In the latter instance it is possible to damage the enclosed product.

Another embodiment provides an additional layer of material above the hand hole to reinforce the hand hole. In one embodiment this material is attached to the side wall. In another embodiment this material is attached to the end wall.

DETAILED DESCRIPTION OF THE PREFERRED EMBODIMENTS

Figure 1:
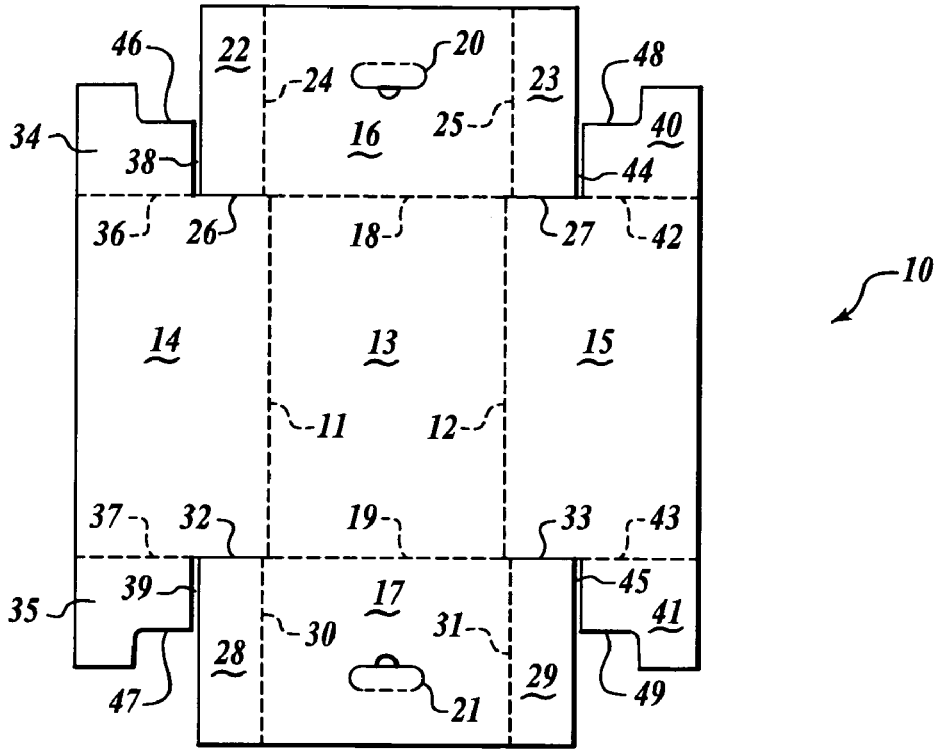
FIG. 1 is a top plan view of an embodiment of a blank for the box.
Figure 2:
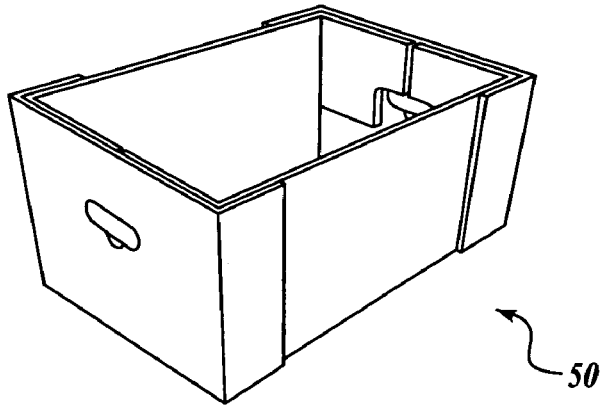
FIG. 2 is an isometric view of the box formed from the blank of FIG. 1.
Figure 3:
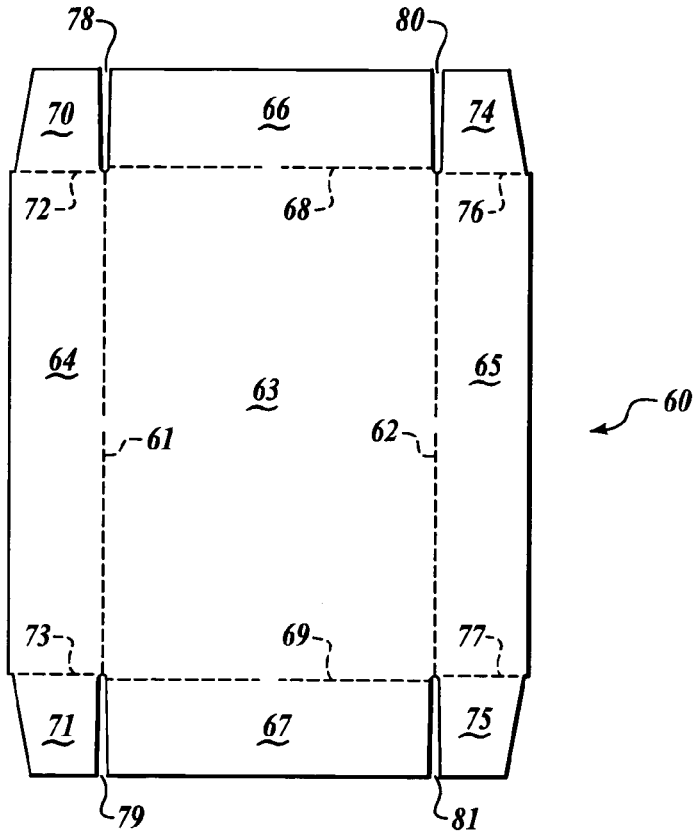
FIG. 3 is a top plan view of a blank for the cover.
Figure 4:
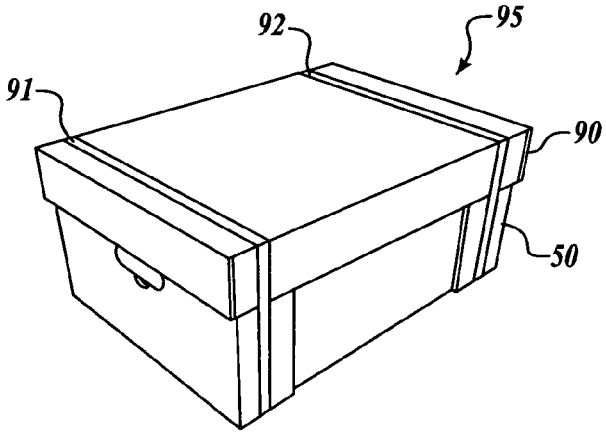
FIG. 4 is an isometric view of the container formed from the box of FIG. 2 and the cover made from the blank of FIG. 3.

In FIG. 1, the blank 10 is divided by longitudinal score lines 11 and 12 into a bottom wall 13 and opposing side walls 14 and 15. End walls 16 and 17 are also attached to bottom wall 13 by transverse score lines 18 and 19. There are no score lines within the side walls 11 and 12, and no longitudinal score lines within the end walls 16 and 17.

Hand holes 20 and 21 are formed in end walls 16 and 17, respectively.

Corner panels 22 and 23 are attached to end wall 16 by longitudinal score lines 24 and 25. Corner panels 22 and 23 are separated from the side walls 14 and 15 by lines 26 and 27. Corner panels 28 and 29 are attached to end wall 17 by longitudinal score lines 30 and 31. Corner panels 28 and 29 are separated from side walls 14 and 15 by lines 32 and 33. Lines 26, 27, 32 and 33 can be cut lines or slots. There are no score lines within the corner panels 22, 23, 28 and 29.

The score lines 24 and 30 are transversely outside of and parallel to score line 11, and the score lines 25 and 31 are transversely outside of and parallel to score line 12 to allow the corner panels to attach to the outside of side walls 14 and 15.

Reinforcing panels 34 and 35 are attached to side wall 14 by score lines 36 and 37. Reinforcing panel 34 is separated from the corner panel 22 by line 38. Reinforcing panel 35 is separated from corner panel 28 by line 39. Reinforcing panels 40 and 41 are attached to side wall 15 by score lines 42 and 43. Reinforcing panel 40 is separated from the corner panel 23 by line 44. Reinforcing panel 41 is separated from corner panel 29 by line 45. The lines 38, 39, 44 and 45 can be cut lines or slots. There are no score lines within the reinforcing panels 34, 35, 40 and 41.

Figure 5:
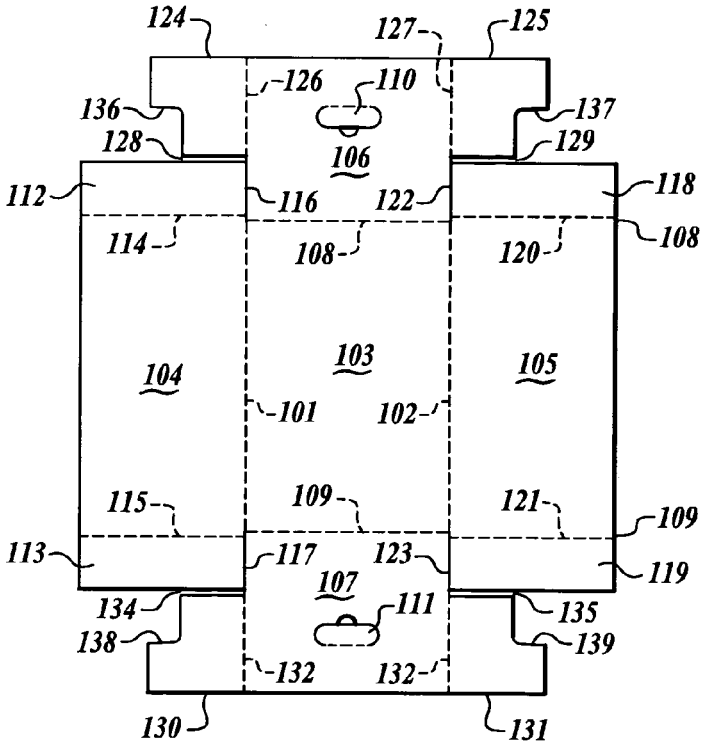
FIG. 5 is top plan view of another embodiment of a blank for the box.
Figure 6:
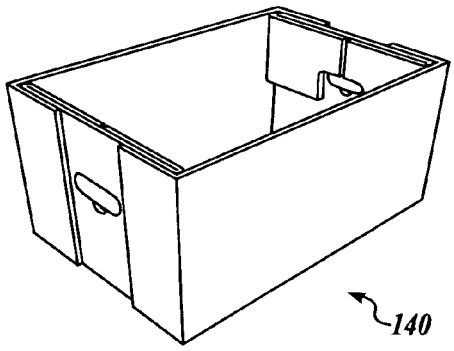
FIG. 6 is an isometric view of the box formed from the blank of FIG. 1.
Figure 7:
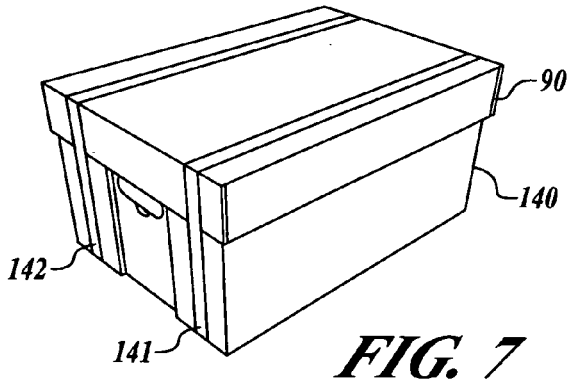
FIG. 7 is an isometric view of the container formed from the box of FIG. 5 and the cover made from the blank of FIG. 3.

In FIG. 5, the blank 100 is divided by longitudinal score lines 101 and 102 into a bottom wall 103 and opposing side walls 104 and 105. End walls 106 and 107 are also attached to bottom wall 103 by transverse score lines 108 and 109. There are no score lines within the side walls 104 and 105, and there are no longitudinal score lines within the end walls 106 and 107.

Hand holes 110 and 111 are formed in end walls 106 and 107, respectively.

Corner panels 112 and 113 are attached to side wall 104 by transverse score lines 114 and 115. Corner panels 112 and 113 are separated from the end walls 106 and 107 by lines 116 and 117. Corner panels 118 and 119 are attached to side wall 105 by transverse score lines 120 and 121. Corner panels 118 and 119 are separated from end walls 106 and 107 by lines 122 and 123. Lines 116, 117, 122 and 123 can be cut lines or slots. There are no score lines within the corner panels 112, 113, 118 and 119.

The score lines 114 and 120 are longitudinally outside of and parallel to score line 108, and the score lines 115 and 121 are longitudinally outside and parallel to score line 109 to allow the corner panels to attach to the outside of end walls 106 and 107.

Reinforcing panels 124 and 125 are attached to end wall 106 by score lines 126 and 127. Reinforcing panel 124 is separated from the corner panel 112 by line 128. Reinforcing panel 125 is separated from corner panel 118 by line 129. Reinforcing panels 130 and 131 are attached to end wall 107 by score lines 132 and 133. Reinforcing panel 130 is separated from the corner panel 113 by line 134. Reinforcing panel 131 is separated from corner panel 119 by line 135. The lines 128, 129, 134 and 135 can be cut lines or slots. There are no score lines within the reinforcing panels 124, 125, 130 and 131.

In forming the box 140, the reinforcing panels 124, 125, 130 and 131 are bent upwardly around score lines 126, 127, 132 and 133 respectively until they overlie and are contiguous with end walls 106 and 107. The reinforcing panels are attached to the end walls along the top of the end walls. The side walls 104 and 105, and end walls 106 and 107 are bent upwardly around score lines 101, 102, 108 and 109 respectively until they are upright with respect to the bottom wall 103. The corner panels 112, 113, 118 and 119 are bent inwardly around score lines 114, 115, 120 and 121 and attached to the outer faces of end walls 106 and 107. The attachment of the corner panels and reinforcing panels to the walls can be by adhesive or staples.

In the embodiment shown the reinforcing panels extend below the hand holes 110 and 111. The reinforcing panels 124, 125, 130 and 131 have cut out sections 136, 137, 138 and 139 respectively. These cut out sections allow the hand holes 110 and 111 to be exposed.

In use the box 140 is filled with product such as wrapped reams of paper. The lid 90 is placed of the box 140, and a pair of straps 141 and 142 are wrapped around the box 140 and the lid 90. The straps should be placed over corner panels so that they do not press in on the product within the container 145. The straps are normally mounted two inches to two and one-half inches from the ends of the container 145 so the corner panels 112, 113, 118 and 119 should be wider than two and one-half inches to insure that the straps are on the corner panels.

While embodiments of the invention has been illustrated and described, it will be appreciated that various changes can be made therein without departing from the spirit and scope of the invention.

The embodiments of the invention in which an exclusive property or privlege is claimed are defined as follows:

1. A blank for a container comprising a bottom wall, side walls attached to said bottom wall along first score lines, said first score lines being longitudinal of said blank, said side walls having an outer side opposite said first score lines, each of the side walls having a lower side edge, there being no transverse score lines within said side walls, end walls attached to said bottom wall along second score lines, said second score lines being transverse of said blank, there being no longitudinal score lines within said end walls, corner panels attached to the sides of the end walls along third score lines, each of said third score lines forming both a side edge of its respective said end wall and a side edge of its respective said corner panel, said corner panels being the same height as said end walls, there being no score lines within said corner panels, each of the corner panels having a bottom edge, each of said third score lines being parallel to and transversly outside of said first score lines, the bottoms of each of said corner panels being separated from its respective said side wall by first cut lines or slots, each of said first cut lines or slots forming the bottom edge of its respective said corner panel and the lower side edge of its respective said side wall, reinforcing panels attached to said side walls along fourth score lines, each of said reinforcing panels being near the outer side of its respective said side wall, each of said reinforcing panels having a height along its respective said fourth score line that is less than the height of the side walls, each of said reinforcing panels being separated from its respective said corner panel by second cut lines or slots, there being no score lines within each of said reinforcing panels.

2. The blank of claim 1 further comprising a hand hole formed in each of said end walls, said reinforcing panels having cut-out sections which align with said hand holes in the erected container.

3. A blank for a container comprising a bottom wall, side walls attached to said bottom wall along first score lines, said first score lines being longitudinal of said blank, there being no transverse score lines within said side walls, end walls attached to said bottom wall along second score lines, said second score lines being transverse of said blank, said end walls having an outer side opposite said second score lines, each of said end walls having a lower side edge, there being no longitudinal score lines within said end walls, corner panels attached to the sides of the side walls along third score lines, each of said third score lines forming both a side edge of its respective said side wall and a side edge of its respective said corner panel, said corner panels being the same height as said side walls, there being no score lines within said corner panels, each of the corner panels having a bottom edge, each of said third score lines being parallel to and transversly outside of said second score lines, the bottoms of each of said corner panels being separated from its respective said end wall by first cut lines or slots, each of said first cut lines or slots forming the bottom edge of its respective said corner panel and the lower side edge of its respective said end wall, reinforcing panels attached to said side walls along fourth score lines, each of said reinforcing panels being near the outer side of its respective said end wall, each of said reinforcing panels having a height along its respective said fourth score line that is less than the height of the end walls, each of said reinforcing panels being separated from its respective said corner panel by second cut lines or slots, there being no score lines within each of said reinforcing panels.

4. The blank of claim 3 further comprising a hand hole formed in each of said end walls, said reinforcing panels having cut-out sections which align with said hand holes in the erected container.

* * * * *